US011077384B2

(12) United States Patent
Talios et al.

(10) Patent No.: US 11,077,384 B2
(45) Date of Patent: Aug. 3, 2021

(54) ELECTRIC RIDE-ON VEHICLE WITH SAFETY CONTROL

(71) Applicant: Dynacraft BSC, Inc., American Canyon, CA (US)

(72) Inventors: William Talios, Petaluma, CA (US); John Bisges, Buford, GA (US); David Castrucci, Napa, CA (US)

(73) Assignee: Dynacraft, BSC, Port Wentworth, GA (US)

( * ) Notice: Subject to any disclaimer, the term of this patent is extended or adjusted under 35 U.S.C. 154(b) by 521 days.

(21) Appl. No.: 15/970,284

(22) Filed: May 3, 2018

(65) Prior Publication Data

US 2019/0336878 A1 Nov. 7, 2019

(51) Int. Cl.

| | |
|---|---|
| ***A63H 29/24*** | (2006.01) |
| ***A63H 29/22*** | (2006.01) |
| ***A63H 17/26*** | (2006.01) |
| ***A63H 17/38*** | (2006.01) |

(52) U.S. Cl.

CPC ..... *A63H 29/24* (2013.01); *A63H 17/262* (2013.01); *A63H 17/38* (2013.01); *A63H 29/22* (2013.01)

(58) Field of Classification Search

CPC ..... A63H 29/24; A63H 17/00; A63H 7/00; B60R 21/026; B60R 21/12; B62K 9/00; B60L 2200/20; B60L 2200/22

USPC ..... 180/65.1

See application file for complete search history.

(56) References Cited

U.S. PATENT DOCUMENTS

| | | | | | |
|---|---|---|---|---|---|
| 4,015,875 | A | * | 4/1977 | Setina | B60R 21/12 296/24.46 |
| 4,055,250 | A | * | 10/1977 | Mayhew | B65D 81/368 206/457 |
| D259,730 | S | * | 6/1981 | Arad | D21/434 |
| D279,589 | S | * | 7/1985 | Marshall | D21/434 |
| D280,115 | S | * | 8/1985 | Takeuchi | D21/558 |
| 4,639,646 | A | * | 1/1987 | Harris | B60L 50/52 318/139 |
| D295,772 | S | * | 5/1988 | Kwan | D21/552 |

(Continued)

OTHER PUBLICATIONS

Instructables, "Power Wheels Mods—Master Kill Switch and Charging," <http://www.instructables.com/id/Power-Wheels-Mods-Master-Kill-Switch-and-Charging/> webpage available at least as early as Aug. 22, 2015.

(Continued)

*Primary Examiner* — John D Walters
*Assistant Examiner* — Hilary L Johns
(74) *Attorney, Agent, or Firm* — Michael Best & Friedrich LLP

(57) ABSTRACT

An electric toy vehicle includes a vehicle body having a front compartment and a rear compartment. A set of surface engaging members is rotatably connected to the vehicle body. A motor is operatively connected to the surface engaging members. A moveable divider is positioned between the front compartment and the rear compartment. The divider is moveable between a first position and a second position. A switch includes a first state and a second state. When the divider is in the first position the switch is in the first state and when the divider is in the second position the switch is in the second state. When the switch is in the first state, the motor is prevented from operating the surface engaging members.

20 Claims, 7 Drawing Sheets

(56) References Cited

U.S. PATENT DOCUMENTS

D305,555 S * 1/1990 Spielberger ..... D21/554
5,229,703 A * 7/1993 Harris ..... H02J 7/0029 320/107
D352,075 S * 11/1994 Washington ..... D21/434
5,439,071 A * 8/1995 Rodriguez-Ferre .... A63H 30/04 180/167
D366,071 S * 1/1996 Harrod ..... D21/431
D382,922 S * 8/1997 Dirden ..... D21/552
5,845,724 A * 12/1998 Barrett ..... A63H 17/38 180/65.1
5,859,509 A * 1/1999 Bienz ..... H02P 7/285 318/139
5,934,727 A * 8/1999 Storc ..... B60P 3/40 296/26.11
6,039,626 A * 3/2000 Gerald ..... A63H 17/262 446/175
D445,465 S * 7/2001 Ma ..... D21/552
D445,466 S * 7/2001 Ma ..... D21/552
6,276,751 B1 * 8/2001 Ikarashi ..... B60N 2/366 296/146.1
6,349,786 B1 * 2/2002 Gift ..... A63G 25/00 180/271
6,416,104 B1 * 7/2002 Fisher ..... B60N 2/3013 296/190.11
6,478,355 B1 * 11/2002 Van Eden ..... B60N 2/3013 296/146.2
6,771,034 B2 * 8/2004 Reile ..... B60L 50/40 318/139
6,786,535 B1 * 9/2004 Grzegorzewski .... B60N 2/3013 296/146.16
7,243,746 B1 * 7/2007 Vasant ..... B62D 31/003 180/6.5
D550,787 S * 9/2007 Stewart ..... D21/552
D569,449 S * 5/2008 Chung ..... D21/431
7,566,094 B2 * 7/2009 Polewarczyk ..... B60J 1/1861 296/190.11
D601,207 S * 9/2009 Chung ..... D21/434
7,726,688 B2 * 6/2010 Setina ..... B60R 21/06 280/748
7,735,896 B2 * 6/2010 Kubota ..... B60N 2/3013 296/69
8,136,857 B2 * 3/2012 Shimizu ..... B60R 21/06 296/26.09
D673,624 S * 1/2013 Kasahara ..... D21/434
8,708,388 B2 * 4/2014 Setina ..... B62D 27/00 296/24.4
D710,460 S * 8/2014 Hattori ..... D21/552
D714,880 S * 10/2014 Hattori ..... D21/551
D730,864 S * 6/2015 Stewart ..... D14/168
D760,325 S * 6/2016 Sano ..... D21/552
9,771,017 B1 9/2017 Talios et al.
D861,082 S * 9/2019 Talios ..... D21/552
2002/0142702 A1 * 10/2002 Kim ..... A63H 29/22 446/484
2005/0202752 A1 * 9/2005 Bryner ..... B62J 99/00 446/465
2006/0170236 A1 * 8/2006 Porter ..... B60R 5/04 296/37.16
2006/0175101 A1 * 8/2006 Drosendahl ..... H02K 11/27 180/65.1
2007/0013201 A1 * 1/2007 Wagner ..... B60N 2/36 296/24.43
2009/0039675 A1 * 2/2009 King ..... B60N 2/305 296/182.1
2010/0059968 A1 * 3/2010 Asbach ..... B60D 1/58 280/446.1
2011/0012548 A1 1/2011 Wilcox et al.
2014/0097634 A1 * 4/2014 Jones ..... B60R 5/04 296/10
2016/0045835 A1 * 2/2016 Choi ..... A63H 17/02 446/456
2017/0088157 A1 * 3/2017 Young ..... B62B 5/0053
2017/0115009 A1 * 4/2017 Ramphos ..... F24C 15/2042
2019/0176710 A1 * 6/2019 Loveday ..... B60R 5/003

OTHER PUBLICATIONS

Modified Power Wheels, "FAQ—Remote kill switches, and key switches," <http://www.modifiedpowerwheels.com/forum/topic.asp?TOPIC_ID=4821> webpage available at least as early as Jun. 20, 2009.

* cited by examiner

ELECTRIC RIDE-ON VEHICLE WITH SAFETY CONTROL

FIELD

Various exemplary embodiments are directed to powered ride-on vehicles designed as children's toys.

BACKGROUND

Ride-ons are a category of children's toys that typically include a battery-powered, wheeled vehicle. The vehicle can include realistic, kid-sized features that allow a child to sit in or on the vehicle and control its speed and direction. Although many are designed as cars, ride-ons have expanded to cover battery-operated trucks, motorcycles, off-road vehicles, and different animals. As the design and operation of ride-ons evolve and expand, so does the need to provide adequate safety features to protect children as they play.

SUMMARY

According to an exemplary embodiment, an electric toy vehicle includes a vehicle body having a front compartment and a rear compartment. A set of surface engaging members is rotatably connected to the vehicle body. A motor is operatively connected to the surface engaging members. A moveable divider is positioned between the front compartment and the rear compartment. The divider is moveable between a first position and a second position. A switch includes a first state and a second state. When the divider is in the first position the switch is in the first state, and when the divider is in the second position the switch is in the second state. When the switch is in the first state, the motor is prevented from operating the surface engaging members.

According to an exemplary embodiment, an electric toy vehicle includes a vehicle body having a front compartment and a rear compartment. A set of surface engaging members are rotatably connected to the vehicle body. A motor is operatively connected to the surface engaging members. A moveable divider is positioned between the front compartment and the rear compartment. The divider is moveable between a first position and a second position. A latch mechanism is positioned in the divider and configured to retain the divider in the first position or the second position.

According to an exemplary embodiment, an electric toy vehicle includes a vehicle body having a front compartment and a rear compartment. The front compartment includes a seating area and a vehicle control, and the rear compartment includes a kitchen area and a play space. A set of surface engaging members are rotatably connected to the vehicle body. A motor is operatively connected to the surface engaging members, and a battery supplies power to the motor. A moveable divider is positioned between the front compartment and the rear compartment, and the divider is moveable between a first position and a second position. A switch includes a first state and a second state. A controller is operatively connected to the switch, the battery, and the motor. When the divider is in the first position the switch is in the first state, and when the divider is in the second position the switch is in the second state. When the switch is in the first state the motor is prevented from operating the surface engaging members.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
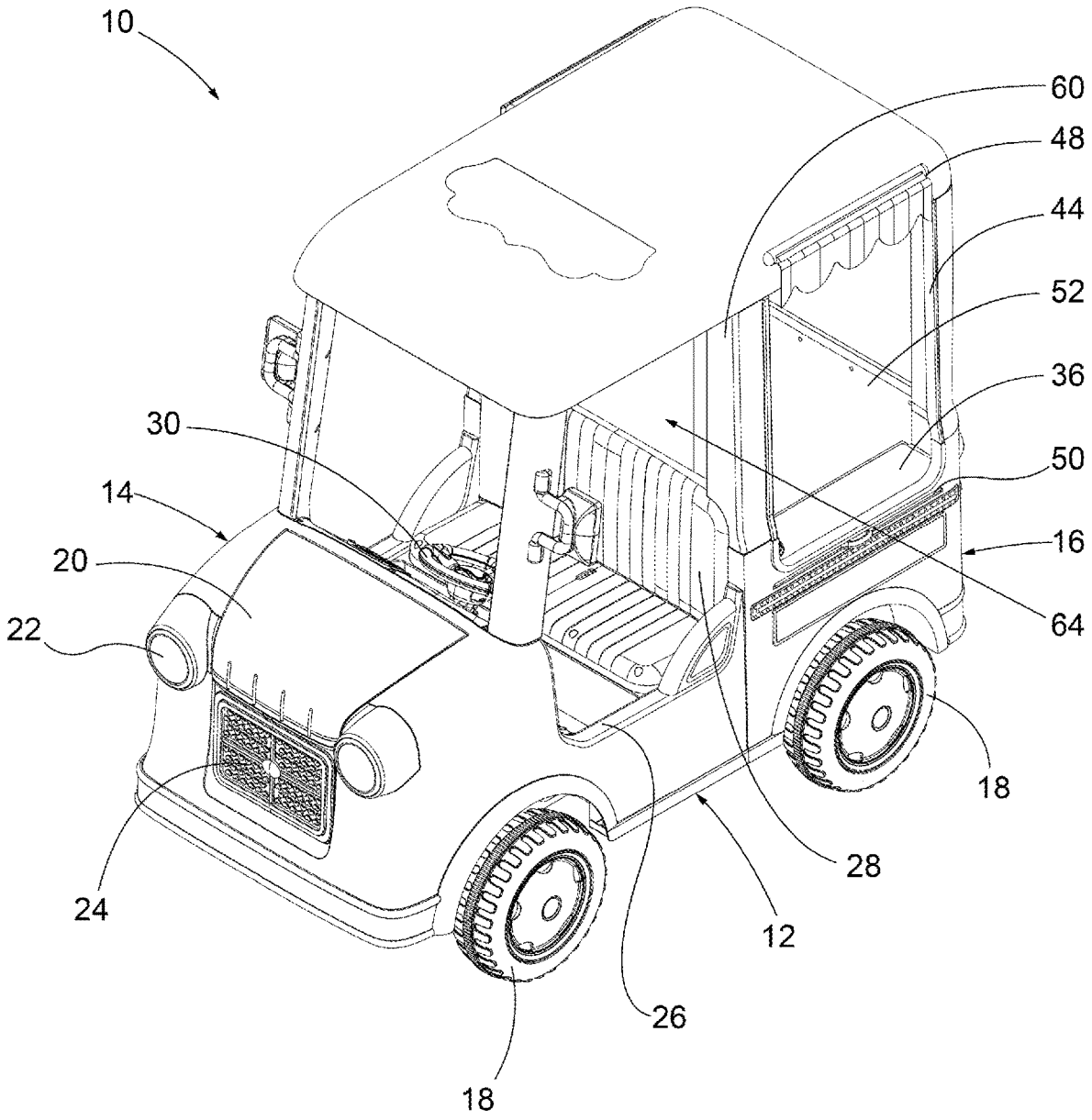
FIG. 1 is a front perspective view of a ride-on toy vehicle.
Figure 2:
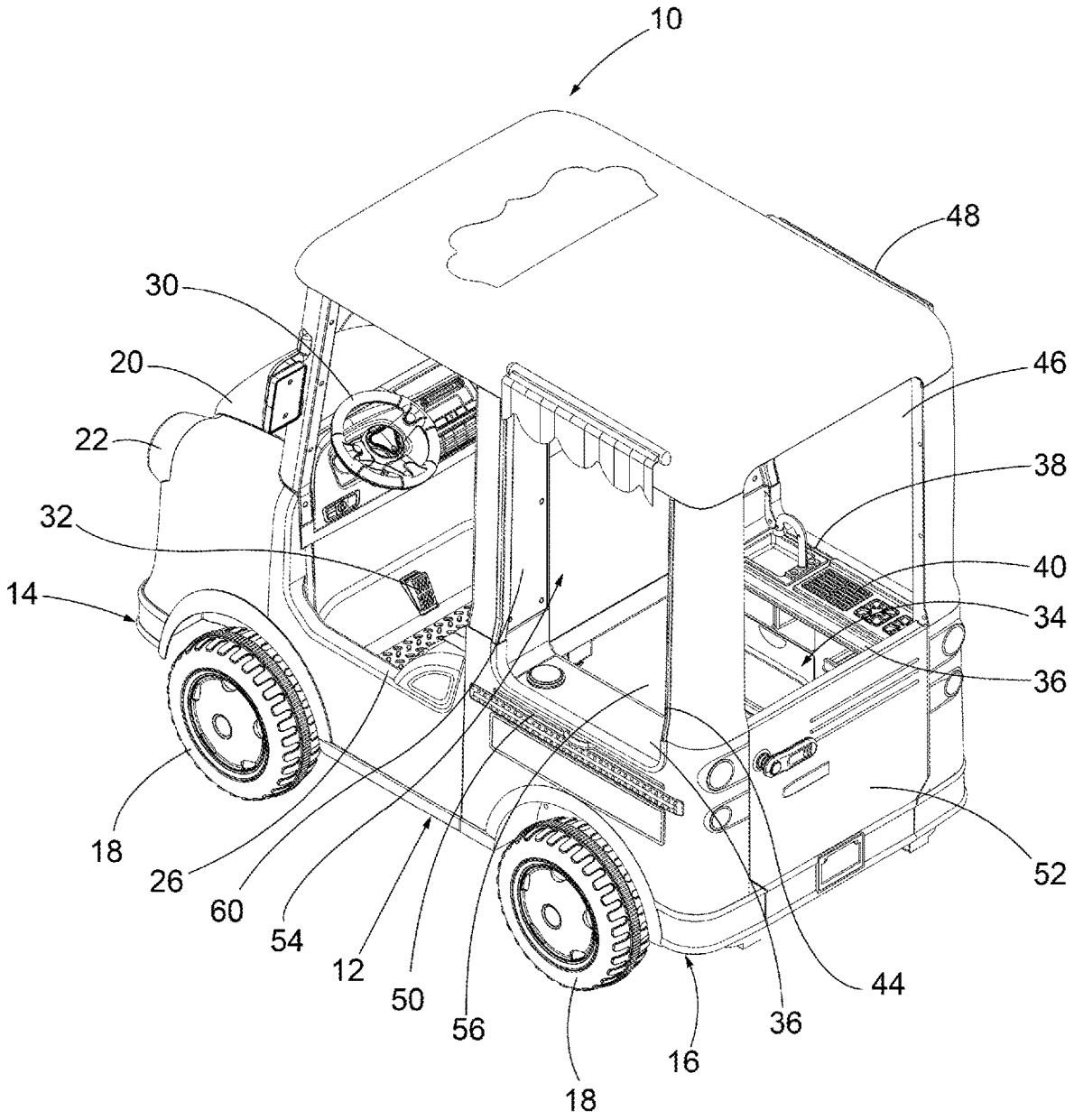
FIG. 2 is a rear perspective view of the ride-on toy vehicle of FIG. 1 with various moveable components in a first position.
Figure 3:
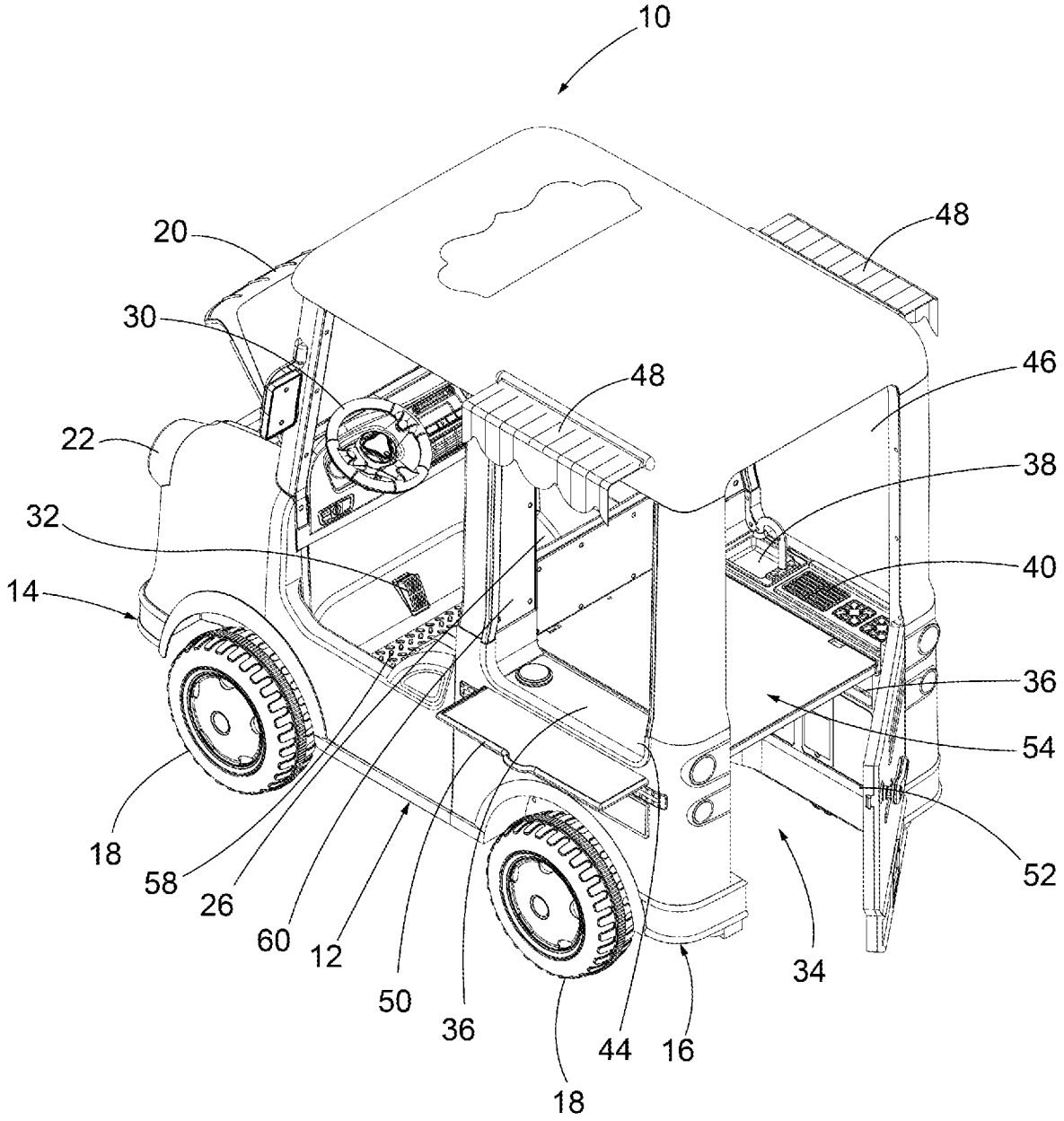
FIG. 3 is a rear perspective view of the ride-on toy vehicle with various moveable components in a second position.

FIGS. 1-3 depict an exemplary embodiment of a ride-on toy vehicle 10 that is designed to resemble a food truck. The vehicle 10 includes a body 12 that is divided into a front section 14 and a rear section 16. Surface engaging members 18 are connected to the body 12 to propel the vehicle 10 along a driving surface such as a floor or ground exterior. The surface engaging members 18 are depicted as a front set of wheels and a rear set of wheels, but other embodiments can include treads, tracks, or other moveable implements. Although the vehicle 10 is depicted as a food truck, various exemplary embodiments disclosed herein can be incorporated into different vehicle types.

The front section 14 includes a moveable hood 20, a set of headlights 22, and a front grill 24. The sides of the front section 14 include openings 26 that allow access to a kid-sized seating area and a set of kid-sized vehicle controls. The seating area is shown as containing a bench seat 28, but other or additional components can be used to support a child during operation of the vehicle. The vehicle controls include a steering wheel 30 and a pedal 32. The seat 28, steering wheel 30, and pedal 32 can be sized and positioned for simultaneous use by a child, for example so that a child sitting on the seat 28 can reach both the steering wheel 30 and the pedal 32. Other controls can be provided, such as a shift or transmission selector that allows a user to select between forward, reverse, or parked options for the vehicle 10.

The rear section 16 includes an interior kitchen area 34. The kitchen area 34 includes decorative or play kitchen components, such as side counters 36, a sink 38, stove 40, and cabinets 42. Positioned between the sides of the kitchen area 34 is a substantially open play space where children can stand to play at preparing and serving food. In the exemplary embodiment, the open play space of the kitchen area 34 is open to the driving surface, however, in other embodiments, a floor or other platform or support can be provided in the kitchen area 34 below the plane of a lowered divider 54, as described hereafter.

The rear section 16 also includes a number of food truck related exterior features including a service window 44 and a kitchen window 46. Moveable awnings 48 can retractably extend from the roof over the service and kitchen window 44, 46. A moveable counter 50 can retractably extend from the body 12 underneath the service window 44. A moveable door 52 extends from the rear of the body 12 and provides access to a kitchen area 34.

As best shown in FIGS. 2 and 3, a moveable divider 54 is positioned to separate the front section 14 and the rear section 16 on the interior of the vehicle 10. The divider 54 is moveably positioned above a rear wall 56. A compartment opening 58 extends between the front seating compartment and the rear kitchen compartment. The compartment opening 58 can be at least partially defined by side posts 60. The divider 54 is moveable between a raised or first position, where it covers the compartment opening 58, and a lowered or second position where it exposes the open play space of the kitchen area 34 and extends perpendicularly relative to the raised position across the kitchen area 34 and covers the open play space at a height above the driving surface or above any floor in the kitchen area. This lowered divider is positioned to preclude children from standing or playing in the kitchen area. In an exemplary embodiment the divider 54 is rotatably connected to the side posts 60, although it can also be rotatably connected to the rear wall 56, and the divider 54's rotation axis extends across the width of the vehicle.

Figure 4:
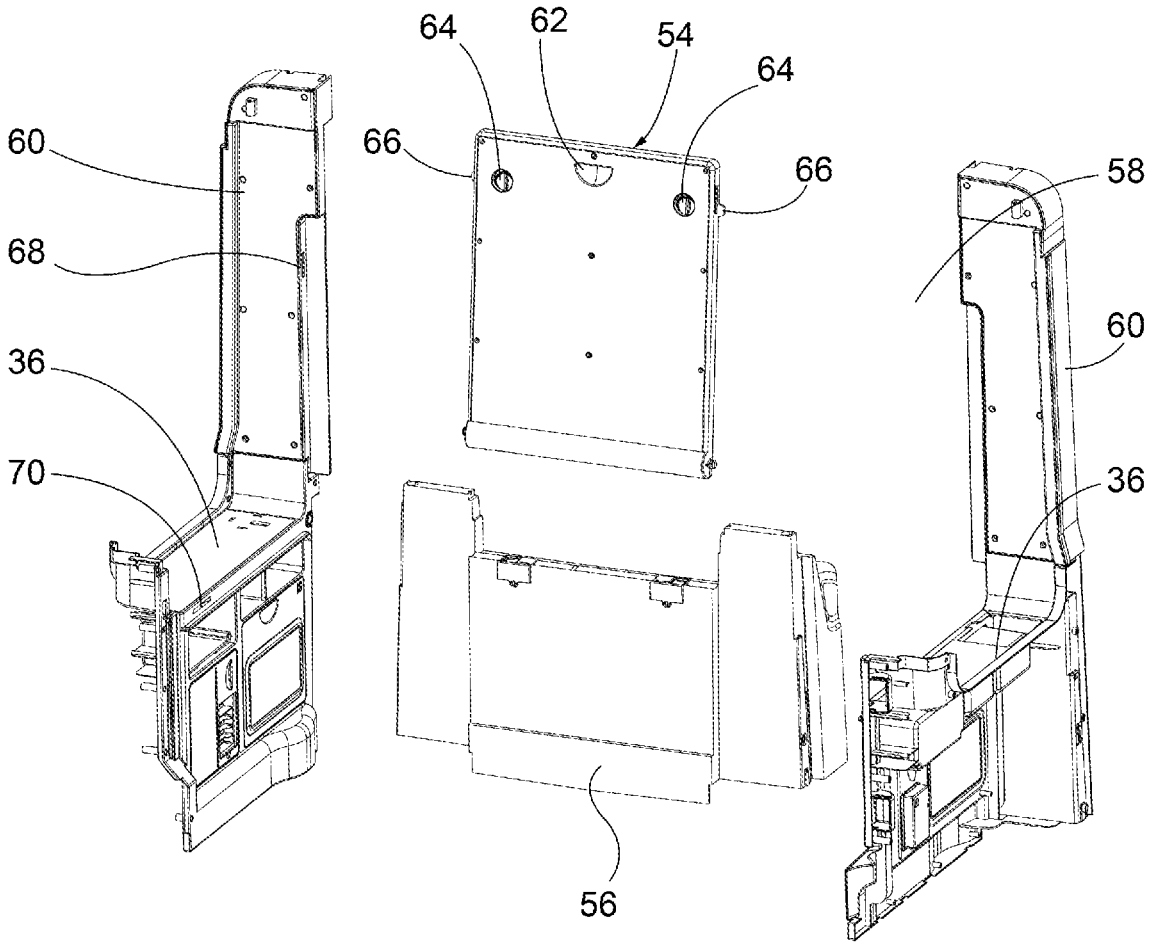
FIG. 4 is a rear perspective, exploded view of the rear wall, divider, side posts, and side counters of the ride-on toy vehicle.

As best shown in FIG. 4, the divider includes a handle 62 and a pair of latch actuators 64. The latch actuators 64 are connected to moveable arms 66 that extend through openings in the side of the divider 54. The side posts 60 include a first set of slots 68 for receiving the arms 66 and the side counters 36 include a second set of slots 70. Rotation of the latch actuators 64 moves the arms 66 from the extended position shown in FIG. 4 to a retracted position inside the divider 54. When in the extended position, the arms 66 can be received in the post slots 68 or the counter slots 70 to retain the divider 54 in a raised or lowered position. Other latch mechanisms can be used, including a latch mechanism that has a single actuator which is connected to both arms.

Figure 5:
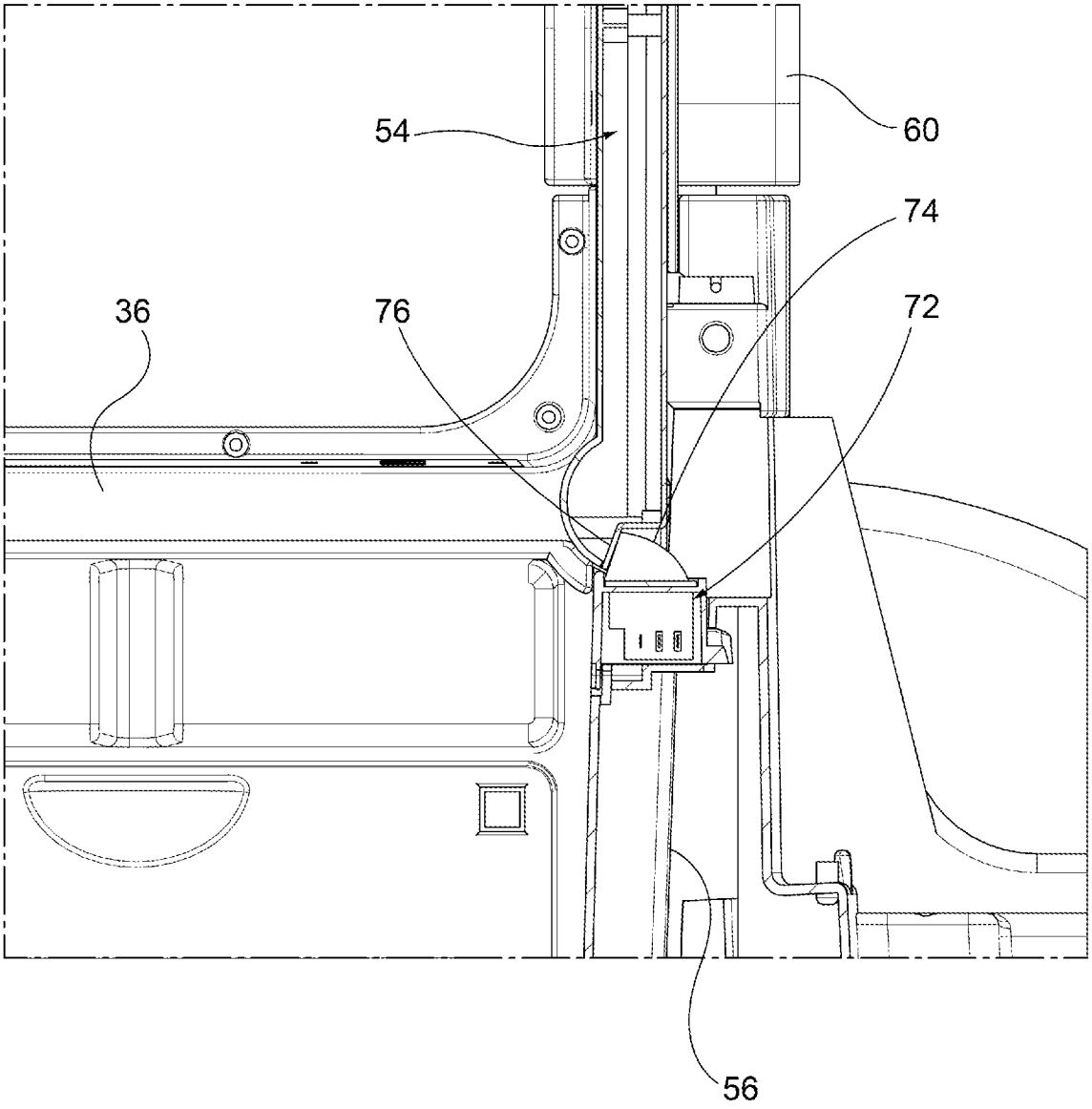
FIG. 5 is a side, sectional view of the ride-on toy vehicle showing the divider and the switch, with the divider in a raised position.
Figure 6:
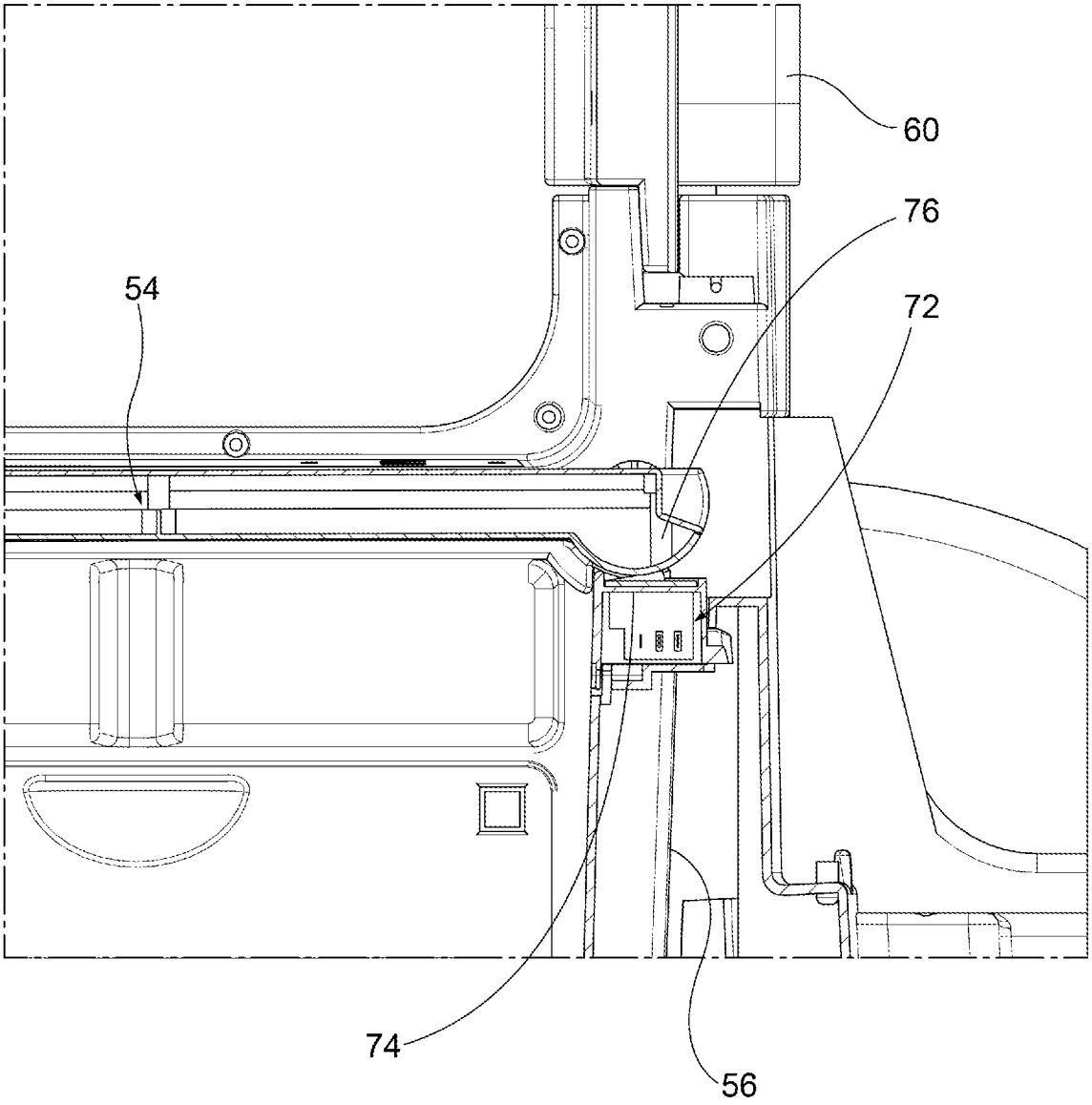
FIG. 6 is a side, sectional view of the ride-on toy vehicle showing the divider and the switch, with the divider in a lowered position.

FIGS. 5 and 6 show a switch 72 associated with the divider 54. In an exemplary embodiment, the switch 72 is positioned on or in the rear wall 56 below the divider 54. The switch 72 includes a moveable actuator 74 that cycles the switch 72 between an on position and an off position. The divider 54 includes a switch engaging portion 76 that selectively contacts the actuator 74.

As shown in FIG. 5, when the divider 54 is in the raised position, the actuator 74 is disengaged from the switch engaging portion 76 so the switch 72 is in the off position. As the divider 54 is lowered, the switch engaging portion 76 contacts and moves the actuator 74. As shown in FIG. 6, when the divider 54 is in the horizontal portion, the actuator 74 is pressed into the switch 72 by the divider 54 and the switch 72 is in the on position. In the exemplary embodiment shown, the actuator 74 and the switch engaging portion 76 of the divider 54 are curved which allows for rotational movement of the divider 54 and corresponding rotational movement of the actuator 74. The engagement of the actuator 74 and divider 54 is beneath the axis of rotation of the divider 54 which allows the divider 54 to engage the switch 72, while the switch 72 remains substantially hidden from view and inaccessible in the rear wall 56.

The vehicle 10 will only move when the switch 72 is in the on position. Accordingly, the vehicle 10 is only capable of moving when the divider 54 is in the lowered position and is covering the open space of the kitchen area 34. When the divider 54 is raised, the switch 72 is in the off position and the vehicle will not move. Requiring the divider 54 to be lowered prior to movement helps prevent the vehicle 10 from moving while children are present in the kitchen area 34. To move the vehicle 10, any children in the kitchen area 34 would need to leave the open space so that the divider 54 can be lowered. Accordingly, the vehicle 10 cannot be moved forward or in reverse while the divider 54 is raised, which could pose a danger to children at play in the open space of kitchen area 34. Although the switch 72 is shown as an electro-mechanical switch 72, the switch 72 may include any suitable number and type of structures or devices for detecting or otherwise determining whether or not the divider 54 is in the lowered position. Non-exclusive examples includes optical switches or sensors, mechanical switches or sensors, magnetic switches or sensors, or other suitable devices.

Figure 7:
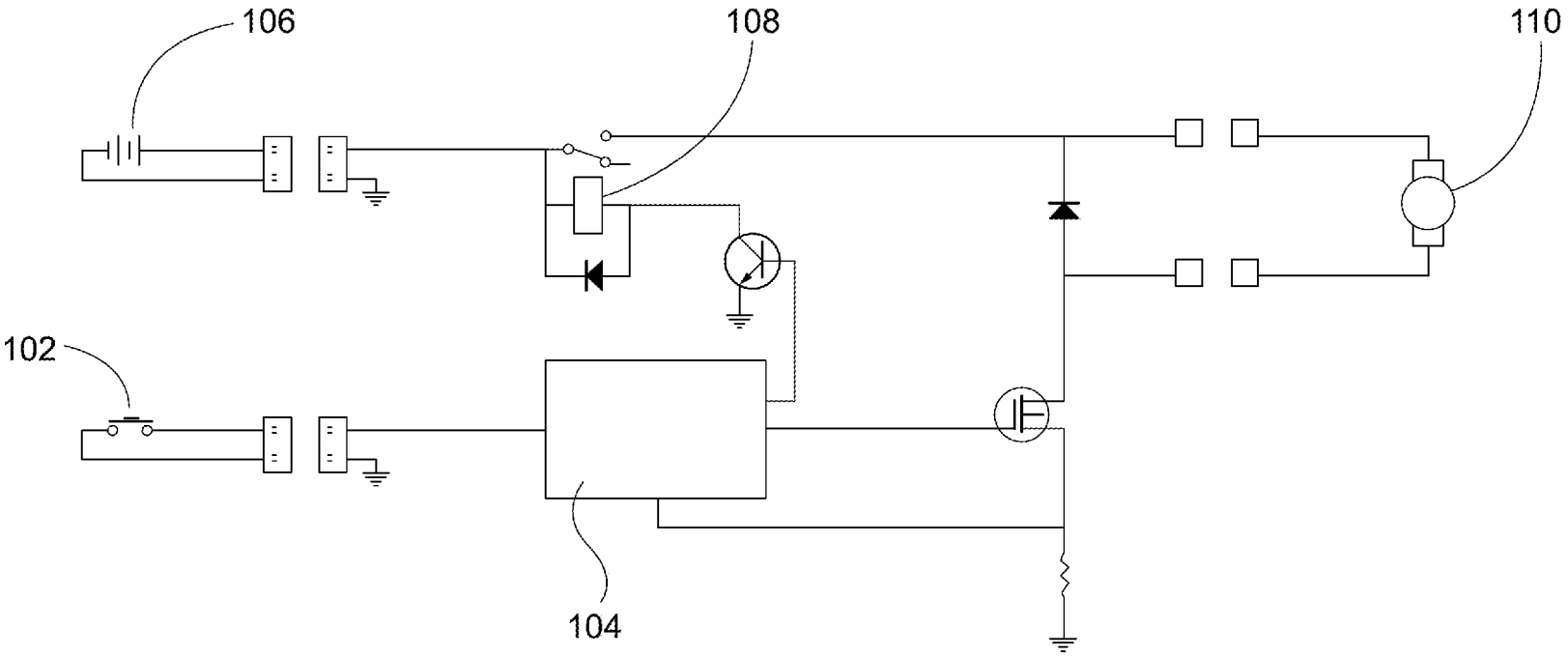
FIG. 7 is an exemplary embodiment of a partial control schematic for the ride-on toy vehicle.

FIG. 7 shows an exemplary control schematic 100 for preventing movement of the vehicle 10 when the divider 54 is in a raised position. The switch 102 is connected to a controller 104 which is also connected to one or more batteries 106, a relay 108, and the motor 110. When the divider 54 is in the raised position, the switch 102 is in the off position or first state and the controller 104 will disengage the relay 108. When the relay 108 is disengaged, the motor 110 will not receive power from the battery 106, regardless of whether the pedal 32 or other input is activated by the user. When the divider 54 is in the lowered position and the switch 102 is on or second state, the controller 104 activates the relay 108. With the relay 108 activated, power is capable of being sent to the motor 110 when the user chooses to activate the motor, and a user can operate the vehicle 10 as normal. As discussed above, the switch 102 can include any combination of mechanical, magnetic, optical, and electrical components.

Consequently, when vehicle is to be moved, the divider 54 must be in the lowered position so that the open space of the kitchen area 34 is covered by the divider and children cannot stand in the open area. When children choosed to stand in the open space of kitchen area 34 to play, the divider must be in the raised position, which prevents the vehicle from moving.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. An electric toy vehicle moveable along a driving surface comprising:

a vehicle body having a front compartment and a rear compartment;

a set of surface engaging members rotatably connected to the vehicle body;

a motor operatively connected to the surface engaging members;

a moveable divider positioned between the front compartment and the rear compartment, the divider moveable between a first position and a second position; and a switch having a first state and a second state, wherein when the divider is in the first position the switch is in the first state and when the divider is in the second position the switch is in the second state, and when the switch is in the first state the motor is prevented from operating the surface engaging members.

2. The electric toy vehicle of claim 1, wherein the rear compartment includes a play space and when the divider is in the second position the divider covers the play space.

3. The electric toy vehicle of claim 2, wherein the play space is substantially open to the driving surface.

4. The electric toy vehicle of claim 1, wherein the divider has a vertical orientation in the first position and a horizontal orientation in the second position.

5. The electric toy vehicle of claim 1, wherein the switch is operatively connected to a controller.

6. The electric toy vehicle of claim 1, wherein the switch includes a moveable actuator and wherein the divider moves the actuator as the divider moves between the first position and the second position.

7. The electric toy vehicle of claim 1, wherein the divider includes a latch mechanism for retaining the divider in the first position and the second positon.

8. An electric toy vehicle moveable along a driving surface comprising:

a vehicle body having a front compartment and a rear compartment;

a set of surface engaging members rotatably connected to the vehicle body;

a motor operatively connected to the surface engaging members;

a moveable divider positioned between the front compartment and the rear compartment, the divider moveable between a first position and a second position; and a latch mechanism positioned in the divider and configured to retain the divider in the first position or the second position, wherein the vehicle body includes a first slot for receiving the latch arm in the first position and a second slot for receiving the latch arm and retaining the divider in the second position.

9. The electric toy vehicle of claim 8, wherein the latch mechanism includes a latch actuator operatively connected to a latch arm.

10. The electric toy vehicle of claim 9, wherein movement of the latch actuator causes the latch arm to move between an extended position and a retracted position.

11. The electric toy vehicle of claim 8, wherein the the latch arm is rotatable to selectively engage the first slot and the second slot.

12. The electric toy vehicle of claim 8, wherein the divider has a vertical orientation in the first position and a horizontal orientation in the second position.

13. The electric toy vehicle of claim 8, wherein the rear compartment includes a play space and when the divider is in the second position the divider covers the play space.

14. The electric toy vehicle of claim 8, further comprising a switch having a first state and a second state, wherein when the divider is in the first position the switch is in the first state and when the divider is in the second position the switch is in the second state, and when the switch is in the first state the motor is prevented from operating the surface engaging members.

15. An electric toy vehicle moveable along a driving surface comprising:

a vehicle body having a front compartment and a rear compartment, wherein the front compartment includes a seating area and a vehicle control and the rear compartment includes a kitchen area and a play space;

a set of surface engaging members rotatably connected to the vehicle body;

a motor operatively connected to the surface engaging members;

a battery supplying power to the motor;

a moveable divider positioned between the front compartment and the rear compartment, the divider moveable between a first position and a second position;

a switch having a first state and a second state;

a controller operatively connected to the switch, the battery, and the motor;

wherein when the divider is in the first position the switch is in the first state and when the divider is in the second position the switch is in the second state, and when the switch is in the first state the motor is prevented from operating the surface engaging members.

16. The electric toy vehicle of claim 15, wherein when the switch is in the first state the controller prevents battery power from reaching the motor.

17. The electric toy vehicle of claim 16, wherein the controller is operatively connected to a relay for selectively connecting the battery with the motor.

18. The electric toy vehicle of claim 15, wherein the switch includes a moveable actuator and wherein the divider moves the actuator as the divider moves between the first position and the second position.

19. The electric toy vehicle of claim 15, wherein the divider includes a latch mechanism for retaining the divider in the first position and the second position.

20. The electric toy vehicle of claim 15, wherein the play space is open to the driving surface and when the divider is in the second position the divider covers the play space.

* * * * *